United States Patent [19]

Mitchell, Jr. et al.

[11] 4,391,665

[45] Jul. 5, 1983

[54] METHOD OF MAKING PILE MATERIAL

[76] Inventors: Paul B. Mitchell, Jr., 2003 Ravenwood Dr., Collinsville, Ill. 62234; Paul B. Mitchell, Box 443, Bryson City, N.C. 28713

[21] Appl. No.: 291,564

[22] Filed: Aug. 10, 1981

[51] Int. Cl.[3] ..... B32B 1/00; B32B 5/00; D04H 11/00

[52] U.S. Cl. ..... 156/72; 156/193; 156/195; 156/265; 156/298; 428/96; 15/159 A; 300/21; 156/297

[58] Field of Search ..... 156/72, 191, 192, 193, 156/195, 265, 242, 243, 297, 298; 428/96; 15/159 A; 300/21, 20; 28/159

[56] References Cited

U.S. PATENT DOCUMENTS

| | | | |
|---|---|---|---|
| 1,135,852 | 4/1915 | Schwarzhaupt | 300/21 |
| 2,078,358 | 4/1937 | Wright, Jr. et al. | 300/21 |
| 2,652,580 | 9/1953 | Neugass | 300/21 |
| 2,664,316 | 12/1953 | Winslow, Jr. et al. | 300/21 |
| 2,861,401 | 11/1958 | Peterson | 300/21 |
| 3,085,922 | 4/1963 | Koller | 156/166 |
| 3,359,147 | 12/1967 | Miller | 156/72 |
| 4,188,429 | 2/1980 | Braconnier et al. | 156/72 |
| 4,221,833 | 9/1980 | Guillermin et al. | 156/72 |
| 4,265,981 | 5/1981 | Campbell | 156/195 |

*Primary Examiner*—Edward C. Kimlin
*Assistant Examiner*—F. K. Wine
*Attorney, Agent, or Firm*—Senniger, Powers, Leavitt and Roedel

[57] ABSTRACT

A method of making pile material comprising pile strands or the like arranged in side-by-side relation, and a backing member bonded to the strands, the method comprising the steps of providing a bundle of pile strands, the strands extending in side-by-side relation and being held in pressurized engagement with each other by a wrapper surrounding the strands, cutting the bundle including the wrapper into slices, and positioning each slice in a form having a wall surrounding the slice and spaced outwardly thereof. The wrapper is removed from the slice, thereby allowing the pile strands to expand laterally outwardly into engagement with the wall of the form for being held by the form. A backing member is thereafter bonded to the pile strands on one face of the slice.

6 Claims, 5 Drawing Figures

METHOD OF MAKING PILE MATERIAL

BACKGROUND OF THE INVENTION

This invention relates to pile material for brushes, carpeting and the like, and more particularly to a method of making such pile material.

This invention involves an imrovement over the prior art method of making pile material, such as discussed for example in U.S. Pat. Nos. 3,085,922 and 3,359,147, comprising the steps of providing a bundle of pile strands impregnated with a binder holding the strands together, cutting the bundle into slabs or wafers, bonding a backing member on the slabs, and then removing the binder material from the slabs. In U.S. Pat. No. 3,085,922, soluble binder material, such as alcohol-soluble terpolyamide resin, is used and this binder material is removed from the slab, after the backing member has been bonded thereto, by rinsing it in the solvent. In U.S. Pat. No. 3,359,147, water is applied to the strands and the wetted bundle is frozen to solidify it. The water is removed from the slab, after the backing member has been bonded thereto, by heating the frozen slab and allowing the water to drain. The use of binder materials in the prior art method thus limits the practice of the method to materials which are compatible with the binders. A further problem with the prior art methods is that the operations of applying a binder to the pile strands and then removing it from the strands are relatively time consuming. Consequently, pile material made according to the prior art method is relatively costly.

SUMMARY OF THE INVENTION

Among the several objects of this invention may be noted the provision of an improved method of making pile material; the provision of such a method in which the pile strands are held together by simple mechanical means both during the cutting of the bundle and during the bonding of the backing member to the strands, thereby eliminating the need to use a binder material during these operations; the provision of such a method which may be used with a greater number of different pile materials than the prior art method; and the provision of such a method which produces pile material more quickly and more economically than is possible with the prior art method.

Briefly, the method of this invention of making pile material comprises providing a bundle of pile strands, the strands extending in side-by-side relation and being held in pressurized engagement with each other by a wrapper surrounding the strands. The bundle including the wrapper is cut into slices, and each slice is positioned in a form having a wall surrounding the slice, the form being of generally the same sectional shape as the slice but of slightly larger sectional area than the slice for providing a space between the periphery of the slice and the wall of the form. The wrapper is removed from the slice, thereby allowing the pile strands to expand laterally outwardly into engagement with the wall of the form, the form thus serving to hold the pile strands. A backing member is then bonded to the pile strands on one face of the slice.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
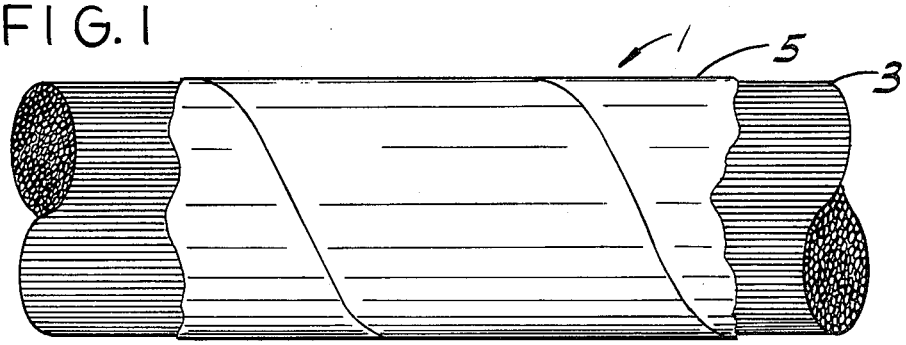
FIG. 1 is a side elevation of a bundle of pile strands held together by a wrapper, end portions of the wrapper being broken away to show the pile strands.
Figure 2:
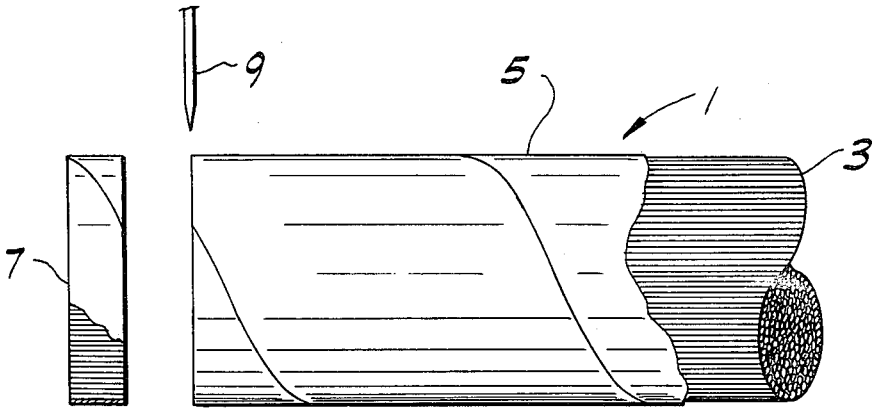
FIG. 2 is a view similar to FIG. 1 showing a slice cut from an end of the bundle.
Figure 3:
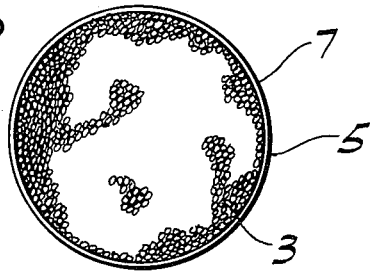
FIG. 3 is an end elevation of the slice of FIG. 2.

Referring to FIG. 1, there is generally indicated at 1 a cylindrical bundle of pile strands 3 extending parallel to the longitudinal axis of the bundle and in side-by-side relation with each other. The pile strands, which may be of any suitable material, such as natural or synthetic thread or fiber, or wire, are held in pressurized engagement against each other by a wrapper 5 surrounding the strands. The wrapper comprises a strip of suitable sheet material, such as paper or plastic, helically wrapped tightly around the strands.

Figure 4:
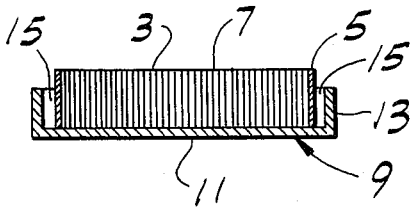
FIG. 4 is a vertical central section of the slice as positioned in a form.

In the method of making pile material of this invention, the bundle 1 (including the wrapper 5) is cut into slices or discs 7 along a cutting plane extending transversely of the bundle by conventional cutting means, such as blade 9. Each slice cut from the bundle thus has two flat, generally parallel end faces. As illustrated in FIG. 4, one of the slices 7, with the wrapper 5 still tightly wrapped thereon, is positioned in a generally circular form 9 having a bottom 11, an open top, and a side wall 13 surrounding the slice and having a height less than the thickness of the slice, thereby exposing the upper end of the slice. The form 9 is of slightly larger sectional area than the slice for forming a space such as indicated at 15 between the slice and the side wall of the form providing access to the wrapper 7 from the open top of the form.

Figure 5:
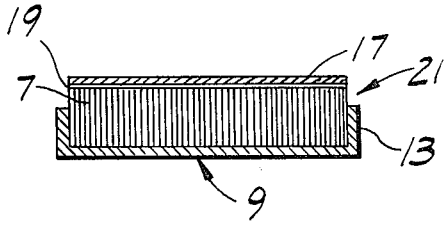
FIG. 5 is a view similar to FIG. 4 but with the wrapper removed from the slice and a backing member bonded on the top thereof.

With the slice 7 positioned in the form, the wrapper is severed and removed from the slice via the space 15, thereby allowing the pile strands 3 to expand laterally outwardly into engagement with the side wall 13 of the form. As shown in FIG. 5, the form 9 serves to hold the pile strands vertical when the wrapper has been removed. A backing member 17 of suitable sheet material is bonded to the pile strands 3 at the exposed upper face of the slice 7 by a layer of suitable adhesive 19 to form a completed pile material member generally designated 21.

The pile material member 21 may be used as a component of a pile material product, such as a brush, and as such secured to a support member of the product, such as the body of the brush. Alternatively, a plurality of the pile material members 21 may be joined together in side-by-side relation to form carpeting. The particular materials of construction of the pile strands, the backing member, and the adhesive, of course, depend upon the intended use of the pile material member.

While thread-like pile strands have been described above and shown in the drawings as being used n the method of this invention, it is to be understood that elongate pile of other configurations, such as sheet material, could be used. Also, while the bundle has been shown and described as being cylindrical and the wrapper as being a helically wound strip, it is contemplated that the bundle may be of any sectional shape, including square or rectangular, and the wrapper may be a tubular member of seamless construction. Further, while the pile strands are shown and described as being bonded to a backing member of sheet material, which in turn may be secured to a support structure of a pile product, such as the body of a brush, it is contemplated that the pile strands may be bonded directly to the support structure of the pile product.

In view of the above, it will be seen that the several objects of the invention are achieved and other advantageous results attained.

As various changes could be made in the above method without departing from the scope of the invention, it is intended that all matter contained in the above description or shown in the accompanying drawings shall be interpreted as illustrative and not in a limiting sense.

What is claimed is:

1. A method of making pile material comprising pile strands or the like arranged in side-by-side relation, and a backing member bonded to the strands, said method comprising the steps of:

(a) providing a bundle of pile strands, the strands extending in side-by-side relation and being held in pressurized engagement with each other by a wrapper surrounding the strands;

(b) cutting the bundle including the the wrapper into slices, each slice having a portion of the wrapper thereon;

(c) positioning each slice with the said portion of the wrapper thereon in a form having a wall surrounding the slice, the form being of generally the same sectional shape as the slice but of slightly larger sectional area than the slice for providing a space between the periphery of the slice and the wall of the form;

(d) removing the said portion of the wrapper from the slice, thereby allowing the pile strands to expand laterally outwardly into engagement with the wall of the form, the form thus serving to hold the pile strands; and (e) bonding a backing member to the pile strands on one face of the slice.

2. The method of claim 1 wherein an adhesive material is applied between the backing member and said one face of the slice to bond them together.

3. The method of claim 1 wherein the bundle is wrapped by helically wrapping a strip of sheet material around the strands.

4. The method of claim 1 wherein the slices are cut from the bundle in a plane generally perpendicular to the longitudinal axis of the bundle so that the faces of each slice are generally parallel to each other and generally perpendicular to the longitudinal axis of the slice.

5. The method of claim 1 wherein the form has a bottom and an open top, and wherein each slice is positioned in the form with said one face thereof exposed at the top of the form and its other face bearing on the bottom of the form.

6. The method of claim 5 wherein the strands extend above the upper end of wall of the form, and wherein the backing member is bonded to the upper ends of the pile strands.

* * * * *